US009461430B1

(12) United States Patent
Dobson et al.

(10) Patent No.: US 9,461,430 B1
(45) Date of Patent: Oct. 4, 2016

(54) PANEL WITH RECEPTACLES TO RECEIVE DIFFERENT TYPES OF USB CONNECTORS

(71) Applicants: George Dobson, DeLand, FL (US); Margaret Dobson, DeLand, FL (US)

(72) Inventors: George Dobson, DeLand, FL (US); Margaret Dobson, DeLand, FL (US)

( * ) Notice: Subject to any disclaimer, the term of this patent is extended or adjusted under 35 U.S.C. 154(b) by 0 days.

(21) Appl. No.: 14/813,913

(22) Filed: Jul. 30, 2015

(51) Int. Cl.
*H01R 13/72* (2006.01)
*H01R 27/02* (2006.01)

(52) U.S. Cl.
CPC ..... *H01R 27/02* (2013.01); *H01R 13/72* (2013.01)

(58) Field of Classification Search
CPC ..... H01R 13/60; H01R 13/72; H01R 25/003
USPC ..... 439/501, 502–508
See application file for complete search history.

(56) References Cited

U.S. PATENT DOCUMENTS 3,257,497 A * 6/1966 Marston ..... H01R 13/72 174/135
6,301,752 B1 10/2001 Koppang
8,132,302 B2 3/2012 Wilkinson
8,203,077 B2 6/2012 Honeycutt et al.
8,523,098 B2 9/2013 Detweiler
9,038,795 B2 5/2015 Ichikawa
9,042,591 B2 5/2015 Millikan
2011/0300744 A1* 12/2011 Garry ..... B60L 3/0069 439/501
2012/0115353 A1* 5/2012 Watanabe ..... H01R 13/514 439/501
2012/0220162 A1* 8/2012 Zhou ..... H01R 13/72 439/501
2012/0322297 A1* 12/2012 Frenkil ..... B65H 75/06 439/501
2013/0023148 A1* 1/2013 Yap ..... H01R 25/003 439/501
2013/0149893 A1* 6/2013 Bisesti et al. ..... H01R 31/06 439/502

* cited by examiner

*Primary Examiner* — Chandrika Prasad
(74) *Attorney, Agent, or Firm* — Terry M. Sanks, Esq.; Beusse Wolter Sanks & Maire, PLLC

(57) ABSTRACT

A system comprising a panel with at least a first receptacle formed in the panel to receive at least one of an electrical outlet plug in at least two arrangements and at least a first universal serial bus (USB) type plug and a second USB type plug so that when received the electrical outlet plug, the first USB type plug and the second USB type plug remains within the receptacle when the panel is orientated in at least one of a nearly vertical position and a vertical position. An apparatus is also disclosed.

20 Claims, 9 Drawing Sheets

PANEL WITH RECEPTACLES TO RECEIVE DIFFERENT TYPES OF USB CONNECTORS

BACKGROUND

Embodiments relate to a storage system and, more particularly, to a system for storing electrical and digital cords.

As the use of mobile technology increases, consumers own numerous cord associated with varying devices, for either powering the device, transferring data to or from the device, or both. Many consumers may possess more than 10 specific cords, where the cords are either electrical power cords, USB cords or both.

When it is time to store the cords, many consumers bundle or wind these cords. They then may store them in a drawer, or some other container, or leave them plugged into an electrical outlet or the device itself. When storing them, the cords may become tangled either with itself or with other cords or items placed in or at the same storage location.

Attempts have been made and patents issued, such as from cable ties, hollow tubes, pegs for winding around, etc., to keep these cords in an organized fashion and in one convenient location. However, these attempts include winding, spooling or folding the cords in a restrictive accordion fashion that eventually wears and frays the cords. The prior attempts do not appear to take into consideration the wear and tear a wrapped cord may endure. Secondarily, the inventors have discovered that not one earlier attempt takes into consideration the tight manufacturing tolerances to retain cord prongs or plugs to a device.

There is a need by consumers for a device, or system, that stores detachable cords in a convenient location and where storage does not damage the cords.

SUMMARY

Embodiments relate to a system and apparatus for storing a cord assembly with a cord part of the cord assembly in a vertical, downward direction. The system comprising a panel with at least a first receptacle formed in the panel to receive at least one of an electrical outlet plug in at least two arrangements and at least a first universal serial bus (USB) type plug and a second USB type plug so that when received the electrical outlet plug, the first USB type plug and the second USB type plug remains within the receptacle when the panel is orientated in at least one of a nearly vertical position and a vertical position.

The apparatus comprises a panel. The apparatus further comprises at least a first cruciform-shaped receptacle formed within the panel to receive an electric plug, having prongs, of a first cord assembly with the prongs in one of a first orientation and a second orientation that is separated by ninety degrees from the first orientation. The apparatus also comprises at least a second cruciform-shaped receptacle formed within the panel to receive at least a type "A" Universal Serial Bus (USB) plug of a second cord and a type "B" USB plug of at least the second cord assembly or a third cord assembly.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
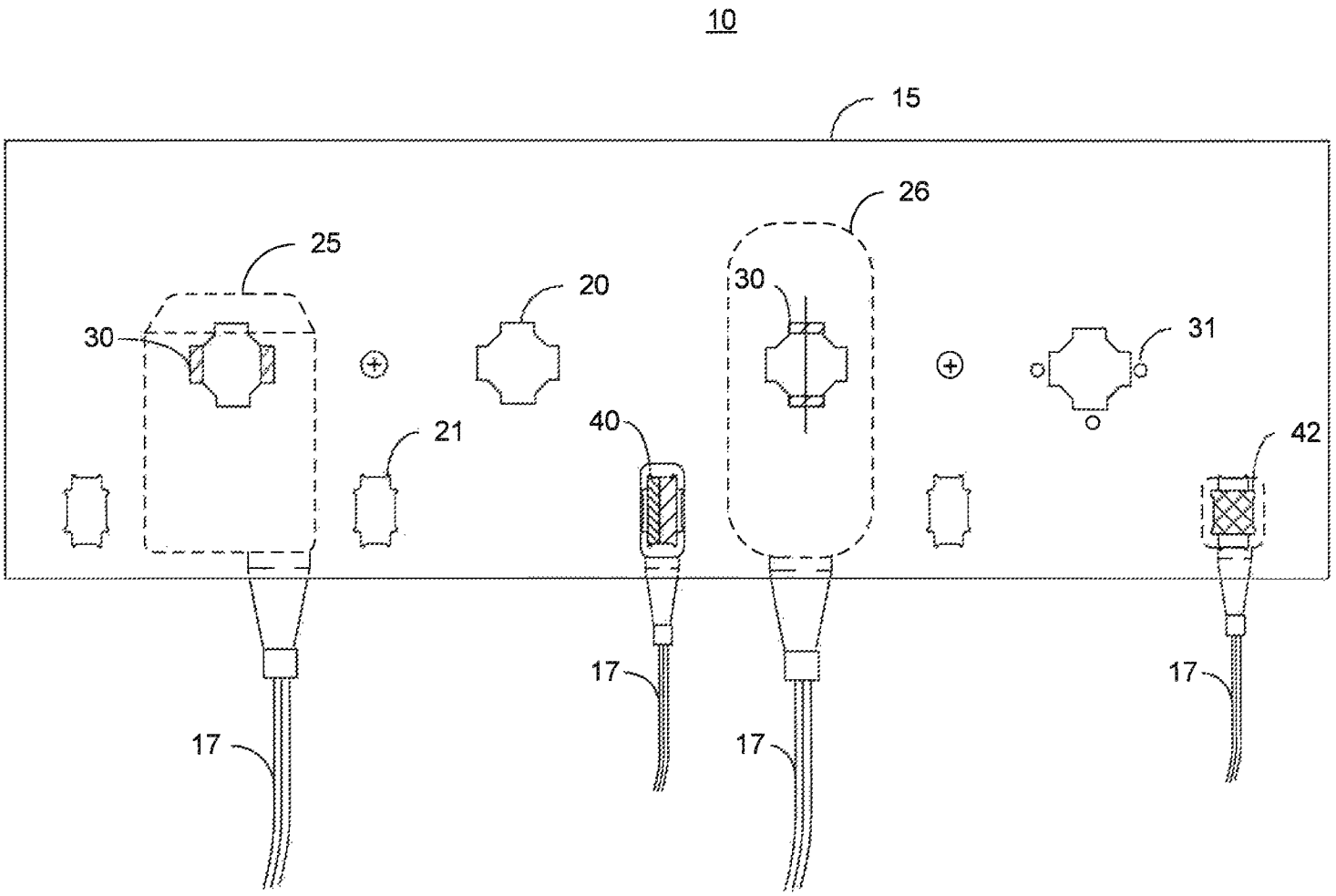
FIG. 1 shows an embodiment of a system for storing cords viewed from a backside of a front panel of the system.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

FIG. 1 shows an embodiment of a system for storing cords viewed from a backside of a panel of the system. As shown, the system 10 comprises a panel 15 or board. At least one cruciform-shaped receptacle 20, 21 is formed within or through the panel 15.

In this embodiment, looking forward from the back or backside of the board or panel 15, shown are National Electrical Manufacturers Association ("NEMA") two-pronged style un-grounded electrical plugs 25, 26, to which a cord 17 is attached, and Universal Serial Bus ("USB") type "A" and "B" plugs 40, 42, to which a cord 17 is attached, inserted within a respective cruciform-shaped receptacle 20, 21 of the system 10. As further illustrated, based on the placement of the two-pronged style electrical plugs 25, 26, the cruciform-shaped receptacle 20 associated with this type of plug is configured to receive parallel prongs 30, or blades, on the electrical plugs whether the prongs are orientated in a vertical direction, as shown with the first plug 25, or in a horizontal direction, as shown with the second plug 26. In a similar manner, a single cruciform-shaped receptacle 21 is configured to receive a USB plug wherein the plug may be either a type "A" plug 40 or type "B" USB plug 42. When the plugs 25, 26, 40, 42 are attached to the panel 15, each respective cord 17 is able to hang freely in a downward direction.

As a non-limiting example, though a plurality of other materials may be used, the panel 15 may be made of a clear or colored acrylic. During the proof of concept development, various materials of different coefficients of friction and textures were tried by the inventors, such as wood (mahogany), 6063 aluminum, polycarbonate, polymethyl methacrylate, plywood and synthetic wood flooring. All of these materials were successful with respect to providing receptacles with sufficient forces generated by friction, along with being able to accept the geometry of the receptacles as disclosed herein to provide tight manufacturing tolerances to produce the system 10 to retain cords when used. Thus, it should be appreciated that any number of different hard or rigid materials may be utilized where a difference between materials used is realized by friction experienced during insertion and withdrawal of the plugs. Depending upon the type of material used, the inventors concluded that the lower coefficient of friction materials provided the better feel and ease of use of the system 10. Though non-limiting, in an embodiment, a thickness of the panel 15 may be between ⅛ inch to ¼ inch.

As is further shown in FIG. 1, and as another non-limiting example, a shaver plug 25 is shown as being secured utilizing the horizontal receptacle slot configuration of the cruciform-shaped receptacle, which the inventors believe a majority of this type of plug exists. The other electrical cord 26 depicted is a cell phone plug whose prongs are at 90 degrees, or horizontal configuration, to its axis. Therefore this plug 26 has to use the vertical slot allocation of the cruciform-shaped receptacle 20 in the board 15. With respect to the USB receptacle, the first USB plug 40 shows a standard USB type "A" plug insertion and the second USB plug 42 shows a standard USB type "B" plug insertion. In both cases with respect to the electrical plugs 25, 26 the cruciform-shaped receptacle 20 may receive either orientation (horizontal or vertical) an electrical plug. The same is true with respect to the cruciform-shaped receptacle 21 for USB plugs. More specifically, the USB receptacle 21 may receive either the type "A" or the type "B" USB plug. As illustrated, with respect to the USB plugs 40, 42, the receptacle 21 accepts the USB plug 42 at a 90 degree or 270 degree (East or West) orientation USB plug 40 at a 0 degree or 180 degree (North or South) location, when 0 degree is identified as a base or bottom of the receptacle 21.

Figure 2:
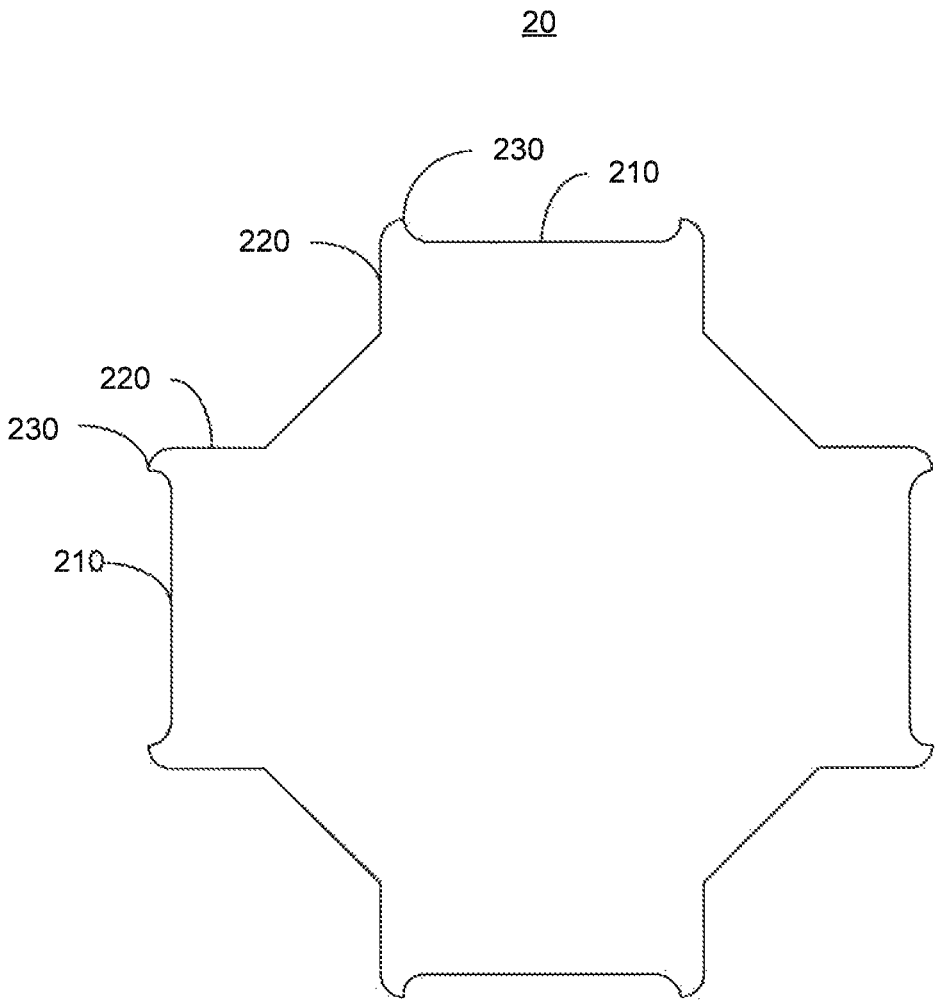
FIG. 2 shows an embodiment of a cruciform-shaped receptacle used within the system.

Though many of FIG. 1 receptacles shown in FIG. 1 are for un-grounded electric plugs 25, 26, a ground receptacle 31 for a grounding prong on a plug with parallel blades 30 may also be included. The ground receptacle 31 is provided adjacent to at least one side 210 (as shown in FIG. 2) of the cruciform-shaped receptacle 20. Three ground receptacles 20 are shown, each adjacent to a side 210 of the receptacle 20. Though three ground receptacles 31 are shown, any number from zero to four may be shown, where the fourth ground receptacle may be located adjacent to the fourth side of the receptacle 20.

FIG. 2 shows an embodiment of a cruciform-shaped receptacle used with the system. A two-prong un-grounded plug 25, 26, with parallel blades 30, and the USB plugs 40, 42 have clearly defined manufacturing tolerances wherein these tolerances were considered by the inventors in providing a maximum profile for the plugs 25, 26, 40, 42 to prevent the plugs from freely falling from the panel 15 when attached. Thus, as explained further below, when plugs 25, 26, 40, 42 are mated or attached to a respective receptacle 20, 21 at least three of the surfaces of the respective plug are in contact with an inner part, or side of the cruciform-shaped receptacle. As configured, for a cord assembly, which as a non-limiting example comprises a plug 25 and cord 17, to fall out of the receptacle 20, 21, without any assistance, it would have to move and overcome forces of friction that are created between the contact of the cruciform-shaped receptacle 20, or receptacle, and the plug 25, 26. Considering the light weight of the cord assembly, the inventors have discovered that this has proved to be unlikely. The inventors further discovered that for the plug 25, 26, 40, 42 to disengage, the board 15, or panel, would have to be tipped, which is extremely unlikely if the panel 15 is affixed correctly to a vertical surface, or nearly vertical surface, as disclosed further herein.

Two-pronged plugs 25, 26 are made with generous chamfers or radii at their tips or prongs, which facilitates easy insertion at all times. USB plugs, which are made to very tight tolerances, have radii along all four insertion edges, again for easy plug-in purposes. To accommodate the prongs, each cruciform-shaped receptacle 20 comprises horizontal and vertical sides 210 and a mating surface 220, and cut-away corners 230. With respect to the electric plug cruciform-shaped receptacle 20, since many electric plugs have one prong that is a greater width than the other prong, the cut-away corners 230 can accommodate both prongs. More specifically, with respect to the electrical plug cruciform-shaped receptacle 20, since some electrical plugs have prongs that tend to run on the high side of the tolerance range, the cut away corners 230 ensure the prong mating surfaces 210, 220 allow the insertion of the plugs 25, 26 and that there is no corner interference experienced.

As shown horizontal and vertical sides 210 of the cruciform-shaped receptacle 20 are positioned to provide for tolerance in the board 15 for mating with a flat side of the electrical prongs 30. During the retention of the cord assembly within the system 10, at least one of these surfaces of the receptacle 20 will be in contact with the side of the prong 30. Sometimes, in rare cases, the outer side of both prongs 30 may be contact with the receptacle 20 as well. Due to an inherent springiness of the prongs 30, insertion into the receptacle 20 may take place with the prongs 30 being pressed towards each other. In these cases, no damage to the prongs 30 will occur due to the fact that insertion forces will not strain the prongs 30 to the yield strength of the material. The end result of this type of mating will be that the plug 25, 26 will only be seated approximately ninety percent (90%) but still be retained in the slot of receptacle 20.

As mentioned above, the mating surface for the prong depth 220 is included. The plug manufacturers give this dimension a generous tolerance which may provide for a significant amount of insertion clearance with the mating surface, or sides 210, 220, 230 of the receptacle 20. A consideration of the manufacturers suggests that smaller rather than bigger material sizes, due to cost consideration, would be the norm, and the inventors found that in a sample tested plugs this was found to be the case.

As also is mentioned above, cut-away corners 230 are provided, which may further be necessary for relief space for the prongs 30. This feature limits a type of manufacture used to produce the panel 15 and is a cost consideration when determining a type of manufacture to be used to produce the panel 15.

Figure 3:
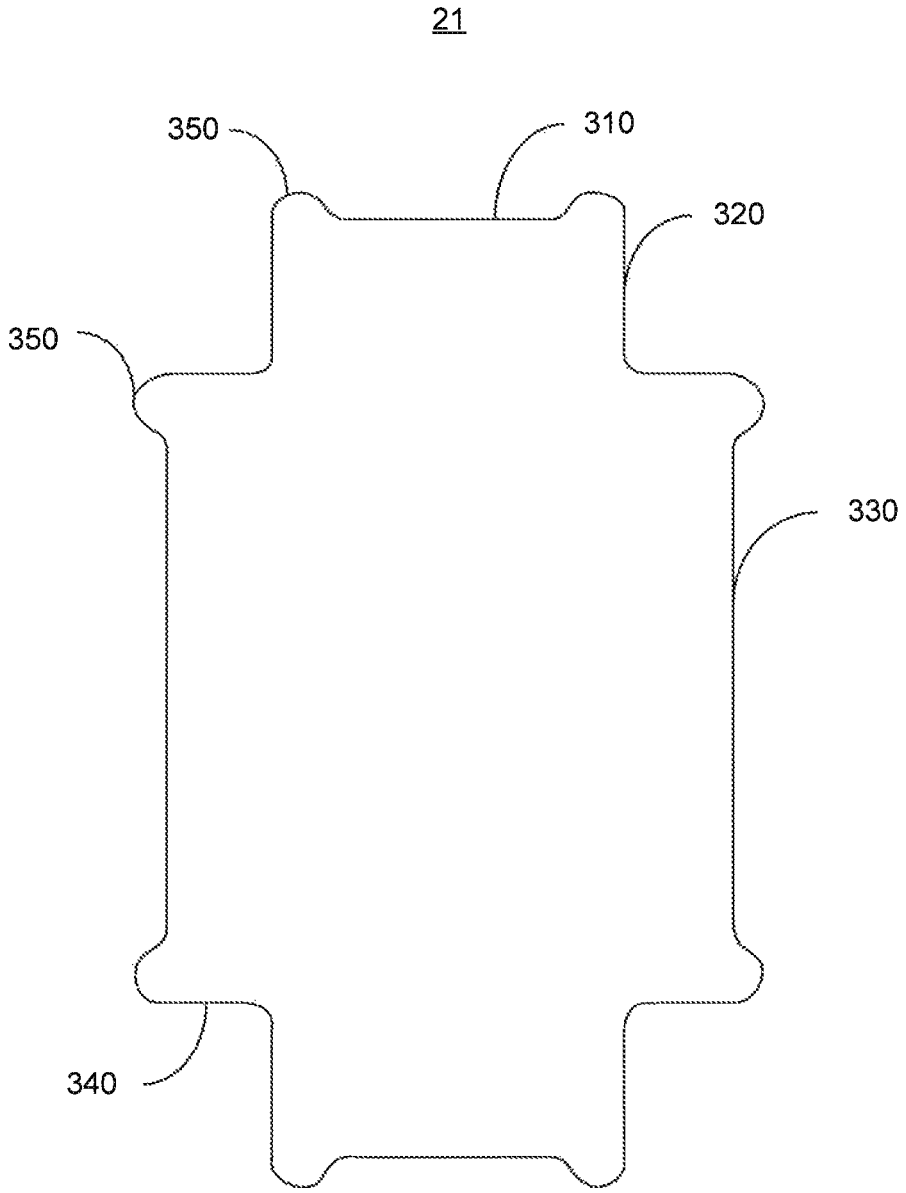
FIG. 3 shows another embodiment of a cruciform-shaped receptacle used within the system.

FIG. 3 shows another embodiment of a cruciform-shaped receptacle used with the system. The receptacle 21 is configured for use with the USB type plugs 40, 42. The configuration of this receptacle 21 is also a cruciform-shaped receptacle. It comprises two first horizontal sides 310 and a first vertical side 320 that together may be in contact with the type "A" connector 40. Also included is a second vertical side 330 and a second horizontal side 340 that provide for contact surfaces for the type "B" plug 42. Cut-away corners 350 provide relief due to the USB plugs only requiring a minimum surface area to retain them within the receptacle 21.

Figure 4:
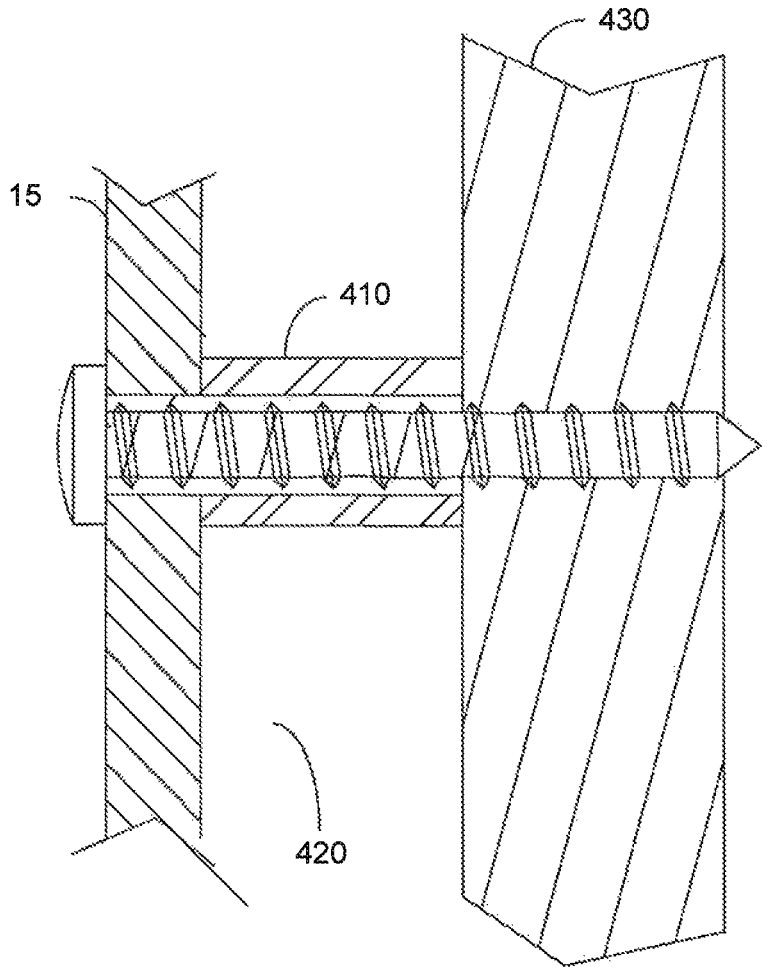
FIG. 4 shows a side view of an embodiment of the system attached to a vertical surface.

FIG. 4 shows a side view of an embodiment of the system attached to a vertical surface. Though the term "vertical surface" is used, the surface may be nearly vertical or partially vertical, therefore the term "vertical" or "vertical surface" is not used herein to be limiting. In an embodiment, a spacer 410 is provided to allow for a standoff 420, or separation area, to receive the 30 prongs that extend beyond the panel 15, as further illustrated in FIG. 6. The spacer 410 may further be used to attach the panel 15 to the vertical surface 430. A length of the spacer 410 may be established so as to prevent the inserted plugs 30 from hitting or contacting the surface 430 to which the panel 15 is attached.

Figure 5:
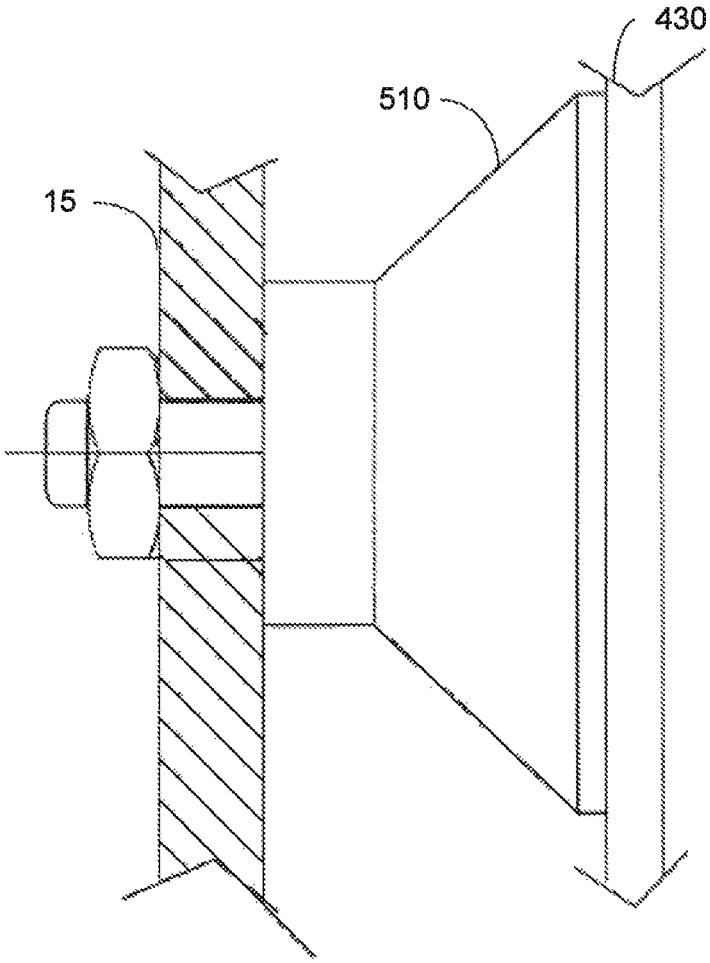
FIG. 5 shows another side view of an embodiment of the system attached to a vertical surface.

FIG. 5 shows another side view of an embodiment of the system attached to a vertical surface. A suction cup spacer 510 may be used to attach the panel 15 to a vertical, or nearly vertical, surface. This arrangement may have an advantage of being portable. As a non-limiting example, the system 10 may comprise a two-receptacle panel 15 having a USB receptacle 21 and an electric plug receptacle 20 that a traveler might take while traveling which may be attached to a mirror or TV in a temporary lodging facility, such as at a hotel room. Placing the system 10 is such visible locations may serve as a visual reminder not to leave the cords behind when checking out of the temporary lodging.

Figure 6:
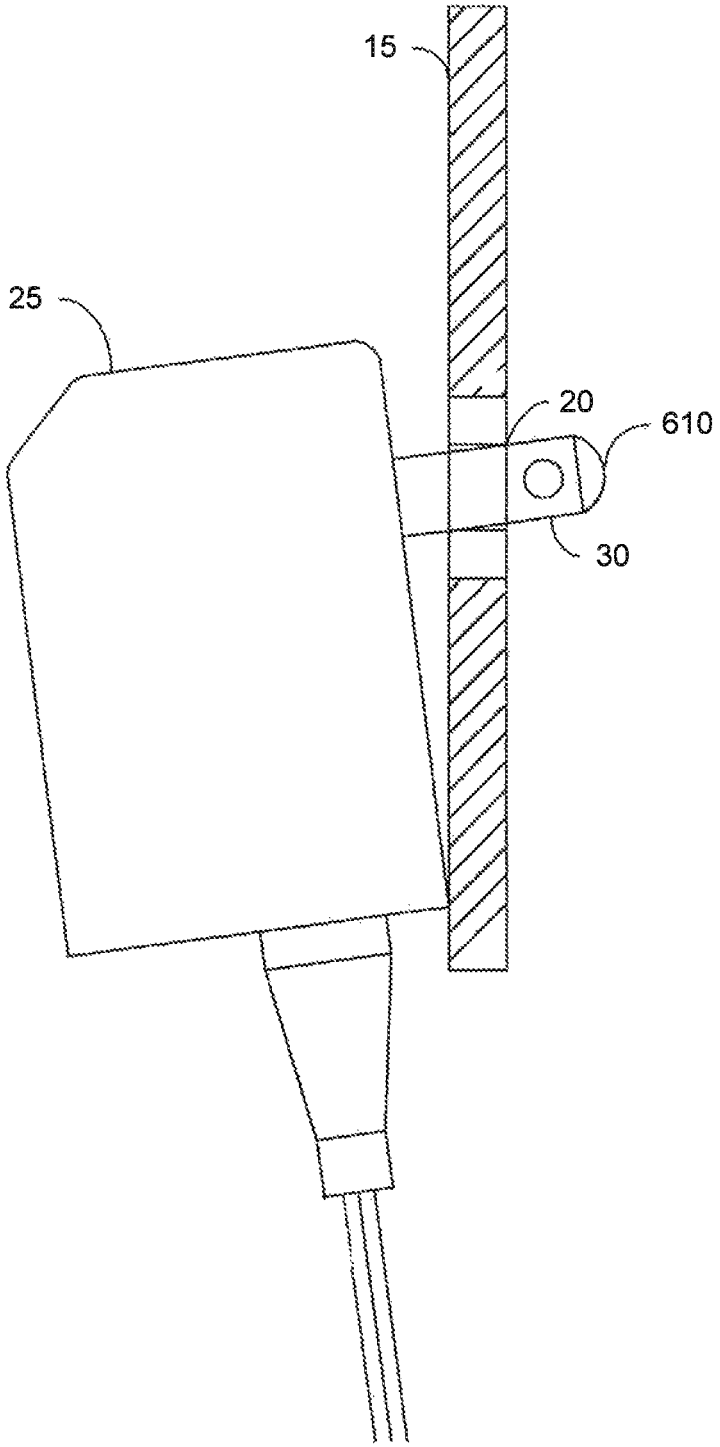
FIG. 6 shows a side view of an embodiment of the front panel of the system with an electrical plug attached.

FIG. 6 shows a side view of an embodiment of the front panel of the system with an electrical plug attached. FIG. 6 is showing a worst-case example of plug prongs 30 made to the lowest end of their tolerance range fitting into the largest end tolerance range of the receptacle 21. The cantilever effect shows the plug 25 and cord 17 still being retained. The tips or ends of the prongs 610 are chamfered and rounded. Typically, electric plugs 25, 26 have a degree of tip relief.

Figure 7:
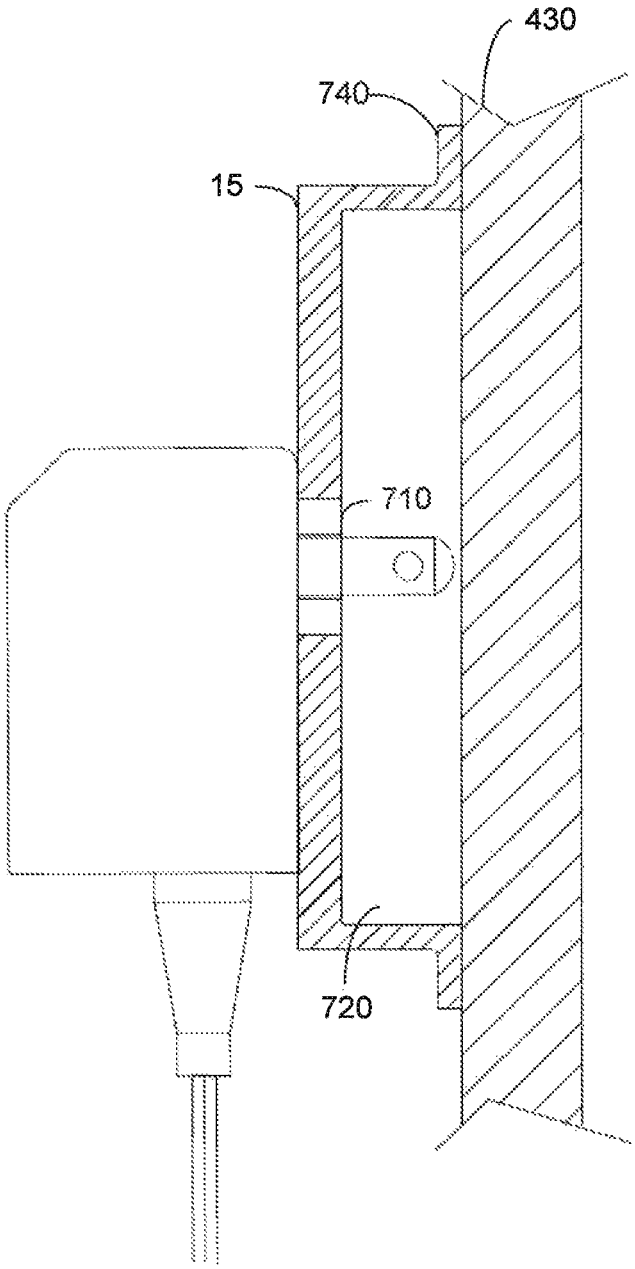
FIG. 7 shows another embodiment of a part of the system from a side view.

FIG. 7 shows another embodiment of a part of the system from a side view. As shown, the panel 15 may be in direct contact with the vertical surface 430 to which the panel 15 is attached. The electric plug cruciform-shaped receptacle 20 may have a uniform opening 710 that extends a distance within the panel 15. An open cavity 720 may then be provided. A shape of the cavity 720 is non-limiting. The cavity 720 may extend at a given distance within the panel 15 before terminating or partially terminating or may extend to the vertical surface 430. In this embodiment, the receptacle 20 may provide a covering for the prongs 30 when the cord assembly 17, 20 is stored with the system. At least one tab 740 is shown which may be used to attach the panel 15 to the vertical surface 430, such as, but not limited to, by inserting a screw or bolt through the tab 740.

In another embodiment, no tab is provided and the panel 15 may be attached by inserting a screw or bolt through the panel 15 directly into the vertical surface 430. In another embodiment, an adhesive, such as, but not limited to, two-sided tape, may be used to attach the panel 15 to the vertical surface 430.

Figure 8:
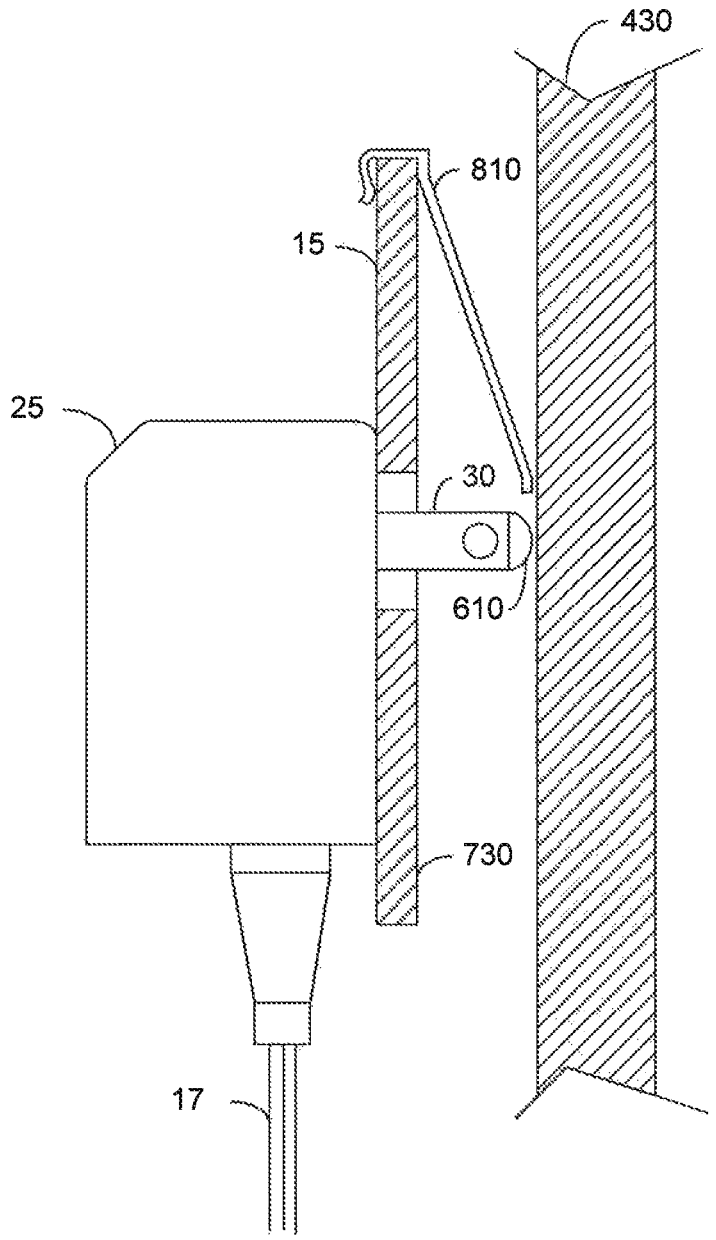
FIG. 8 shows another embodiment of a part of the system from a side view.
Figure 9A:
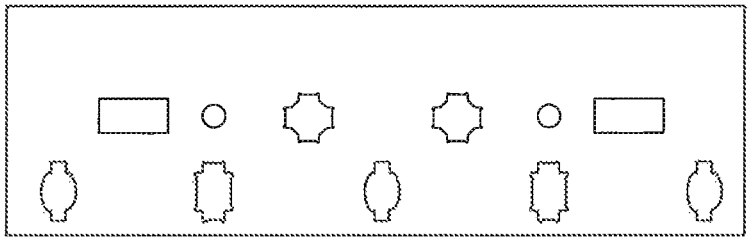
FIGS. 9A-9G show a plurality of embodiments of the system.
Figure 9B:
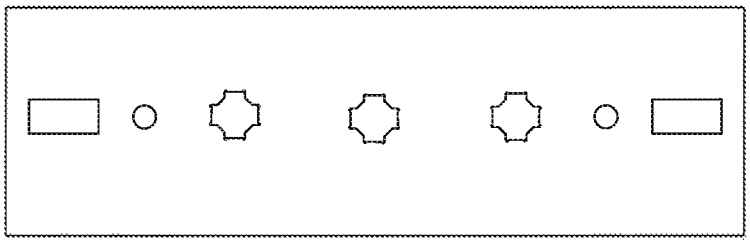
Figure 9C:
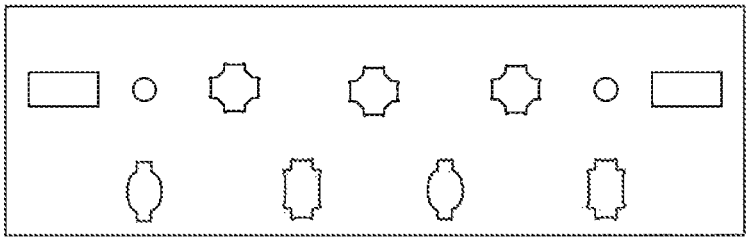
Figure 9D:
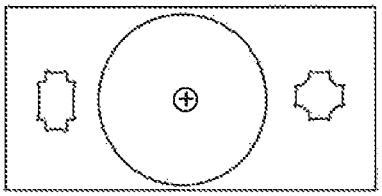
Figure 9E:
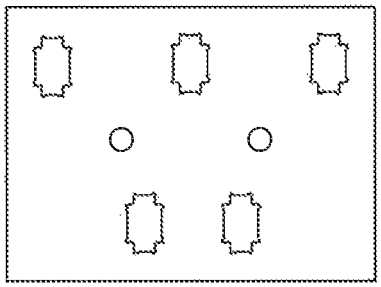
Figure 9F:
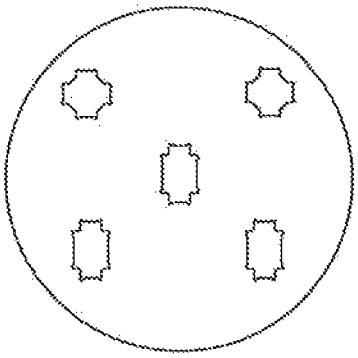
Figure 9G:
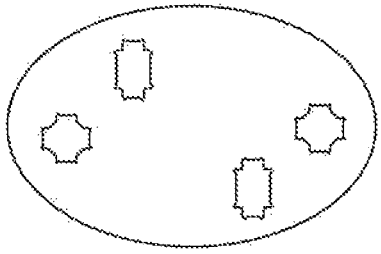

FIG. 8 shows another embodiment of a part of the system from a side view. As shown, when the panel 15 is positioned at a distance from a mounting surface a cover 810 may be provided at a backside 730 of the panel 15, surrounding where the receptacle's backside opening exists. The cover 810 may be included to further protect the prongs 30 or ends of the prongs 610 that extend beyond the backside 730 of the panel 15. A type of cover 810 is non-limiting. As another non-limiting example, the cover 810 may be limited to covering the opening of the receptacle at the backside 730 of the panel 15.

FIGS. 9A-9G show a plurality of embodiments of the system. As shown, and explained above, a configuration for the system is limitless. Though cruciform-shaped receptacles 20, 21 are shown on each system 10 to provide for at least one USB plug 40, 42 and at least one electrical plug 25, 26, the system 10 may comprise only at least one cruciform-shaped receptacle 21 for the USB plug 40, 42 or at least one cruciform-shaped receptacle for the electrical plug. As is suggested by the various configurations shown in FIGS. 9A-9G, the front panel may have any shape and the shapes shown are not provided to be limiting. A shape of the panel 15 is also non-limiting as the shape may be a geometric shape, take a shape of a character, etc.

Thus, the panel 15 may accommodate the plugs' basic design specifications, allowing cord assemblies to be plugged into a non-electrical receptacle 20, 21 that securely retains the plug and length of the cord assembly as the cord 17 is able to hang downward. In a non-limiting example, when the panel 15 is affixed on a wall 430, or vertical surface, at eye level with the cords 17 hanging vertically, identification and accessibility of the required connecting cables is simply obtained. This is obtained without spooling, to avoid kinks or tangles that may damage cords occurring. Orderly storage is a goal for many homeowners and craftsmen in the workplace. Thereby, the embodiments disclosed herein may be expected to improve the life of cord assemblies while storing them in a convenient location.

Though embodiments are disclosed with respect to NEMA plugs, embodiments disclosed herein and the inventive concepts taught herein may be applicable to other forms of plugs, specifically electric plugs. As a non-limiting example, other countries utilize similar shaped plugs, but do not designate their plugs as NEMA plugs.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

We claim:

1. A system comprising a panel with at least a first receptacle formed in the panel to receive an electrical outlet plug in at least one of two arrangements and at least a second receptacle formed in the panel to receive at least one of a first universal serial bus (USB) type plug and a second USB type plug so that when received at least one of the electrical outlet plug in the first receptacle, and at least one of the first USB type plug and the second USB type plug in the second receptacle remains within the first receptacle and the at least second receptacle, respectfully, when the panel is orientated in at least one of a nearly vertical position and a vertical position.

2. The system according to claim 1, wherein at least one of the at least first receptacle and the at least second receptacle comprises a cruciform shape.

3. The system according to claim 1, wherein the at least first receptacle receives the electrical outlet plug with prongs of the electrical outlet plug arranged horizontally or vertically.

4. The system according to claim 1, wherein the at least second receptacle receives at least one of a type "A" USB type plug and a type "B" USB type plug based on an orientation of each respective type plug when placed within the at least second receptacle.

5. The system according to claim 1, further comprising a spacer to define a space between a backside of the panel and surface to which the panel is attached.

6. The system according to claim 1, further comprising a cover located at a backside of at least one of the at least first receptacle and the at least second receptacle to receive an end of at least on of a prong and a plug that extends through the panel.

7. The system according to claim 1, wherein the at least first receptacle comprises a cruciform shape that extends a given distance within the receptacle and then expands to a larger size through another part of the panel.

8. The system according to claim 5, wherein the spacer comprises a suction cup attachment to removable placement and displacement from a surface.

9. The system according to claim 1, further comprising at least a third receptacle to receive a ground plug of the electrical outlet plug.

10. The system according to claim 1, wherein the at least first receptacle comprises at least one arcuate extension protruding from the at least first receptacle to receive a ground plug of the electrical outlet plug.

11. An apparatus to store cords in a downward vertical configuration, the apparatus comprising:

a panel;

at least one of a first cruciform-shaped receptacle formed within the panel to receive an electric plug, having prongs, of a first cord assembly with the prongs in one of a first orientation and a second orientation that is separated by ninety degrees from the first orientation and a second cruciform-shaped receptacle formed within the panel to receive at least one of a type "A" Universal Serial Bus (USB) plug of a second cord assembly and a type "B" USB plug of at least the second cord assembly or a third cord assembly.

12. The apparatus of claim 11, wherein a backside of the panel is separated from a mounting surface to provide for at least one of ends of the prongs and ends of the at least one of the type of type "A" USB plug and the type "B" USB plug to extend beyond the panel without contacting the mounting surface.

13. The apparatus of claim 11, further comprising a spacer to define a space between a backside of the panel and surface to which the panel is attached.

14. The apparatus of claim 13, wherein the spacer comprises a suction cup attachment to removable placement and displacement from a surface.

15. The apparatus according to claim 11, further comprising a cover located at a backside of at least one of the at least first receptacle and the at least second receptacle.

16. The apparatus according to claim 11, wherein the cruciform-shape of the at least first receptacle extends a given distance within the receptacle and then expands to a larger size through another part of the panel.

17. The apparatus according to claim 11, wherein parallel blades of the electrical outlet plug are received within the at least first cruciform-shaped receptacle and a ground plug is received at least at one of a third receptacle and at least one of an arcuate extension formed on a side of the at least first cruciform-shaped receptacle.

18. A system comprising a panel with a first cruciform-shaped receptacle formed in the panel to receive at least one of a first universal serial bus (USB) type plug and a second USB type plug so that when received at least one of the first USB type plug and the second USB type plug remains within the first receptacle when the panel is orientated in at least one of a nearly vertical position and a vertical position.

19. The system according to claim 18, further comprising a second receptacle formed in the panel to receive an electrical outlet plug in at least one of two arrangements.

20. The system according to claim 19, further comprising at least one of a third receptacle to receive a ground plug of the electrical outlet plug and an arcuate extension protruding from the second receptacle to receive a ground plug of the electrical outlet plug.

* * * * *